US009440272B1

(12) United States Patent
Herrin et al.

(10) Patent No.: US 9,440,272 B1
(45) Date of Patent: Sep. 13, 2016

(54) METHOD FOR PRODUCING ALUMINUM ROD AND ALUMINUM WIRE

(75) Inventors: Jeffrey D. Herrin, Carrollton, GA (US); Thomas Noell Wilson, Carrollton, GA (US); Clinton E. Watkins, Villa Rica, GA (US); Emory Barber, Bremen, GA (US); Tom Stephens, Carrollton, GA (US)

(73) Assignee: Southwire Company, LLC, Carrollton, GA (US)

( * ) Notice: Subject to any disclaimer, the term of this patent is extended or adjusted under 35 U.S.C. 154(b) by 1016 days.

(21) Appl. No.: 13/365,279

(22) Filed: Feb. 3, 2012

Related U.S. Application Data

(60) Provisional application No. 61/440,032, filed on Feb. 7, 2011.

(51) Int. Cl.
*B21C 1/00* (2006.01)
*C22F 1/04* (2006.01)

(52) U.S. Cl.
CPC *B21C 1/003* (2013.01); *C22F 1/04* (2013.01)

(58) Field of Classification Search
CPC ..... B21C 37/40; B21C 37/025; B21C 1/003; B21C 37/04; B21C 37/045; B21C 37/047; B21C 1/16; B21C 1/20; B21C 1/00; B21C 1/02; C22F 1/04
USPC ..... 29/825, 149, 274; 72/149, 274, 286, 72/206; 140/164; 148/2, 688; 174/128, 174/128.1, 130, 104
See application file for complete search history.

(56) References Cited

U.S. PATENT DOCUMENTS

| | | | | | |
|---|---|---|---|---|---|
| 1,931,912 | A | * | 10/1933 | Whitzel | 72/201 |
| 2,286,956 | A | | 6/1942 | Dillon | |
| 2,545,866 | A | | 3/1951 | Whitzel et al. | |
| 2,974,778 | A | | 3/1961 | Ellis et al. | |
| 3,278,300 | A | * | 10/1966 | Koike | 420/542 |
| 3,670,401 | A | | 6/1972 | Schoerner | |
| 3,811,846 | A | | 5/1974 | Schoerner et al. | |
| 3,821,843 | A | * | 7/1974 | Medrick et al. | 29/527.7 |
| 3,830,635 | A | * | 8/1974 | Chia et al. | 420/537 |
| 3,834,948 | A | | 9/1974 | Brickner et al. | |
| 3,877,885 | A | | 4/1975 | Sexton | |
| 3,920,411 | A | * | 11/1975 | Schoerner et al. | 420/550 |
| 3,952,571 | A | * | 4/1976 | Yokota | C22F 1/04 148/689 |
| 3,960,606 | A | | 6/1976 | Chia et al. | |
| 3,967,983 | A | | 7/1976 | Chia et al. | |
| 3,989,923 | A | | 11/1976 | Lees et al. | |
| 4,021,521 | A | | 5/1977 | Scholl et al. | |

(Continued)

FOREIGN PATENT DOCUMENTS

| | | |
|---|---|---|
| WO | WO 99-32239 | 7/1999 |
| WO | WO 2010-006313 | 1/2010 |

OTHER PUBLICATIONS

SAPA, entitled "Standards for Aluminum Mill Products" published Dec. 2007; 54 pages.

(Continued)

*Primary Examiner* — Edward Tolan
(74) *Attorney, Agent, or Firm* — Merchant & Gould P.C.

(57) ABSTRACT

Systems, methods, and devices for the production of aluminum rods from aluminum bars, aluminum wires from aluminum rods, and aluminum wires from aluminum bars are disclosed and described. Annealing steps are not needed or required in the disclosed methods.

16 Claims, 1 Drawing Sheet

(56) References Cited

U.S. PATENT DOCUMENTS

| | | | | | |
|---|---|---|---|---|---|
| 4,028,141 | A | | 6/1977 | Chia et al. | |
| 4,080,222 | A | | 3/1978 | Schoerner et al. | |
| 4,080,223 | A | | 3/1978 | Schoerner et al. | |
| 4,082,573 | A | | 4/1978 | Schoerner et al. | |
| 4,087,295 | A | | 5/1978 | Sargent et al. | |
| 4,138,275 | A | | 2/1979 | Yokota et al. | |
| 4,140,549 | A | * | 2/1979 | Chia et al. | 148/551 |
| 4,151,896 | A | * | 5/1979 | Nicoud et al. | 148/551 |
| 4,168,181 | A | | 9/1979 | Perlus et al. | |
| 4,183,771 | A | * | 1/1980 | Setzer et al. | 148/550 |
| 4,192,693 | A | | 3/1980 | Chia et al. | |
| 4,216,031 | A | | 8/1980 | Chia et al. | |
| 4,221,947 | A | | 9/1980 | Bonikowski et al. | |
| 4,234,359 | A | * | 11/1980 | Chia et al. | 148/550 |
| 4,402,763 | A | * | 9/1983 | Sato et al. | 148/552 |
| 4,402,768 | A | | 9/1983 | Flükiger | |
| 4,405,385 | A | * | 9/1983 | Cloostermans-Huwaert | C22F 1/00 148/689 |
| 4,421,304 | A | | 12/1983 | Hesterlee | |
| 4,431,168 | A | | 2/1984 | MacCraven | |
| 4,431,463 | A | | 2/1984 | Althoff | |
| 4,437,901 | A | * | 3/1984 | Gentry | 148/566 |
| 4,518,953 | A | | 5/1985 | Hunter et al. | |
| 4,522,880 | A | | 6/1985 | Klostermeier et al. | |
| 4,863,527 | A | | 9/1989 | Schaeffer et al. | |
| 5,067,994 | A | | 11/1991 | Brubak et al. | |
| 5,123,973 | A | * | 6/1992 | Scott et al. | 148/690 |
| 5,205,986 | A | | 4/1993 | Noordegraaf et al. | |
| 5,269,349 | A | | 12/1993 | Sugier et al. | |
| 5,275,209 | A | | 1/1994 | Sugier et al. | |
| 5,368,109 | A | | 11/1994 | Pittard, Jr. et al. | |
| 5,512,241 | A | | 4/1996 | Kramer et al. | |
| 5,554,826 | A | | 9/1996 | Gentry | |
| 5,908,664 | A | | 6/1999 | Nagayama | |
| 5,945,065 | A | | 8/1999 | Kikuchi et al. | |
| 6,336,495 | B1 | | 1/2002 | McCullough et al. | |
| 6,440,579 | B1 | | 8/2002 | Hauser et al. | |
| 6,559,385 | B1 | | 5/2003 | Johnson et al. | |
| 6,580,021 | B2 | | 6/2003 | Barney | |
| 6,743,396 | B2 | | 6/2004 | Wagner et al. | |
| 6,796,365 | B1 | | 9/2004 | McCullough et al. | |
| 6,896,746 | B2 | | 5/2005 | Tsuchida et al. | |
| 7,201,210 | B2 | * | 4/2007 | Saha et al. | 164/57.1 |
| 7,228,627 | B1 | | 6/2007 | Yoshimura et al. | |
| 7,367,118 | B2 | | 5/2008 | Cheng et al. | |
| 7,615,127 | B2 | * | 11/2009 | Elder et al. | 148/688 |
| 7,824,607 | B2 | | 11/2010 | Kajihara et al. | |
| 2003/0066579 | A1 | | 4/2003 | Bergsma | |
| 2003/0168136 | A1 | | 9/2003 | Kawabe et al. | |
| 2005/0011596 | A1 | | 1/2005 | Tanaka et al. | |
| 2005/0155680 | A1 | | 7/2005 | Nagy et al. | |
| 2006/0201588 | A1 | | 9/2006 | Suda et al. | |
| 2007/0175552 | A1 | | 8/2007 | Sibum et al. | |
| 2008/0135139 | A1 | | 6/2008 | Nagy et al. | |
| 2010/0175795 | A1 | | 7/2010 | Choi et al. | |
| 2010/0263905 | A1 | | 10/2010 | Aoyama et al. | |
| 2011/0266029 | A1 | * | 11/2011 | Sekiya | C22C 21/00 174/126.1 |
| 2012/0328471 | A1 | * | 12/2012 | Sekiya | C22C 21/00 420/546 |

OTHER PUBLICATIONS

ASTM B 233-92 Designation, entitled "Standard Specification for Aluminum 1350 Drawing Stock for Electrical Purposes" published Oct. 1992; pp. 222-225.

ASTM B 609-91 Designation, entitled "Standard Specification for Aluminum 1350 Round Wire, Annealed and Intermediate Tempers, for Electrical Purposes," published Jun. 1991, pp. 440-444.

* cited by examiner

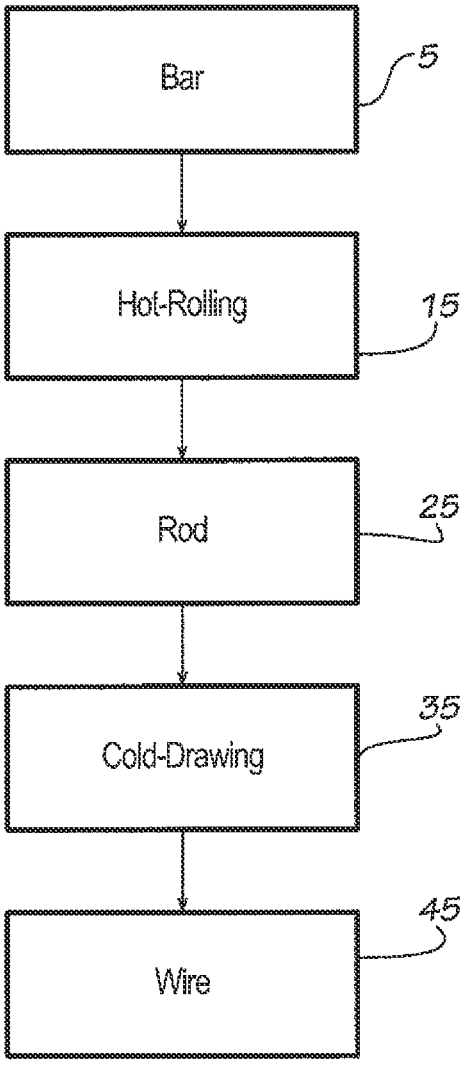
Bar
5
Hot-Rolling
15
Rod
25
Cold-Drawing
35
Wire
45

METHOD FOR PRODUCING ALUMINUM ROD AND ALUMINUM WIRE

REFERENCE TO RELATED APPLICATION

This application claims the benefit of U.S. Provisional Application No. 61/440,032, filed on Feb. 7, 2011, which is incorporated herein by reference in its entirety.

COPYRIGHTS

All rights, including copyrights, in the material included herein are vested in and the property of the Applicants. The Applicants retain and reserve all rights in the material included herein, and grant permission to reproduce the material only in connection with reproduction of the granted patent and for no other purpose.

BACKGROUND

Many aluminum rod and wire production processes require an annealing step to meet the tensile strength and conductivity (IACS) requirements of certain end-use applications. It would be beneficial to produce rod and wire where the additional time, cost, and complexity of an annealing step is not needed or required. Accordingly, it is to these ends that the present disclosure is directed.

SUMMARY

This summary is provided to introduce a selection of concepts in a simplified form that are further described below in the detailed description. This summary is not intended to identify required or essential features of the claimed subject matter. Nor is this summary intended to be used to limit the scope of the claimed subject matter.

Embodiments of the present invention may provide systems, methods, and/or devices for the production of an aluminum rod from an aluminum bar, the production of an aluminum wire from an aluminum rod, and the production of an aluminum wire from an aluminum bar, in which an annealing step is not needed or required.

Consistent with certain embodiments disclosed herein, methods for producing an aluminum rod from an aluminum bar are described. One such method may comprise hot-rolling the aluminum bar at a temperature in a range from about 650° F. to about 1100° F. to reduce the cross-sectional area, producing the aluminum rod. The ratio of the cross-sectional area of the aluminum bar to the aluminum rod may be in a range from about 30:1 to about 150:1 (e.g., from about 50:1 to about 130:1). The resultant aluminum rod, in specific embodiments, is not annealed.

In some embodiments, methods for producing an aluminum wire from an aluminum rod are described. One such method may comprise cold-drawing the aluminum rod at a temperature in a range from about −40° F. to about 400° F. (e.g., from about 40° F. to about 110° F.) to reduce the cross-sectional area, producing the aluminum wire. The ratio of the cross-sectional area of the aluminum rod to the aluminum wire may be in a range from about 3:1 to about 10:1. The resultant aluminum wire, in specific embodiments, is not annealed, nor are there any intermediate annealing steps within the cold-drawing process.

In other embodiments, methods for producing an aluminum wire from an aluminum bar are described. One such method may comprise hot-rolling the aluminum bar at a temperature in a range from about 650° F. to about 1100° F. to reduce the cross-sectional area, producing an aluminum rod; and cold-drawing the aluminum rod at a temperature in a range from about −40° F. to about 400° F. (e.g., from about 40° F. to about 110° F.) to reduce the cross-sectional area, producing the aluminum wire. The ratio of the cross-sectional area of the aluminum bar to the aluminum rod may be in a range from about 30:1 to about 150:1 (e.g., from about 50:1 to about 130:1), and the ratio of the cross-sectional area of the aluminum rod to the aluminum wire may be in a range from about 3:1 to about 10:1. In certain embodiments, neither the aluminum rod nor the aluminum wire is annealed. Hence, the method of producing an aluminum wire from an aluminum bar may be conducted in the absence of any annealing step (e.g., intermediate annealing of the rod, final annealing of the wire, etc.).

Both the foregoing summary and the following detailed description provide examples and are explanatory only. Accordingly, the foregoing summary and the following detailed description should not be considered to be restrictive. Further, features or variations may be provided in addition to those set forth herein. For example, certain embodiments may be directed to various feature combinations and sub-combinations described in the detailed description.

BRIEF DESCRIPTION OF THE DRAWING

The accompanying drawing, which is incorporated in and constitutes a part of this disclosure, illustrates an embodiment of the present invention. In the drawing:

FIG. 1 is schematic flow diagram illustrating a method of producing aluminum wire from an aluminum bar in an embodiment of the present invention.

DETAILED DESCRIPTION

The following detailed description refers to the accompanying drawing. While embodiments of the invention may be described, modifications, adaptations, and other implementations are possible. For example, substitutions, additions, or modifications may be made to the elements illustrated in the drawing, and the methods described herein may be modified by substituting, reordering, or adding stages to the disclosed methods. Accordingly, the following detailed description does not limit the scope of the invention.

The terms "a," "an," and "the" are intended to include plural alternatives, e.g., at least one, unless otherwise specified.

All publications mentioned herein are incorporated herein by reference for the purpose of describing and disclosing, for example, the constructs and methodologies that are described in the publications, which might be used in connection with the presently described invention. The publications discussed throughout the text are provided solely for their disclosure prior to the filing date of the present application. Nothing herein is to be construed as an admission that the inventors are not entitled to antedate such disclosure by virtue of prior invention.

Applicants disclose several types of ranges in the present invention. When Applicants disclose or claim a range of any type, Applicants' intent is to disclose or claim individually each possible number that such a range could reasonably encompass, including end points of the range as well as any sub-ranges and combinations of sub-ranges encompassed therein. For example, in an embodiment of the invention, the ratio of the cross-sectional area of the aluminum bar to the aluminum rod may be in a range from about 30:1 to about 150:1. By a disclosure that the ratio may be in a range from about 30:1 to about 150:1, Applicants intend to recite that the ratio may be about 30:1, about 35:1, about 40:1, about 45:1, about 50:1, about 55:1, about 60:1, about 65:1, about 70:1, about 75:1, about 80:1, about 85:1, about 90:1, about 95:1, about 100:1, about 110:1, about 120:1, about 130:1, about 140:1, or about 150:1. Additionally, the ratio may be within any range from about 30:1 to about 150:1 (for example, the ratio may be in a range from about 50:1 to about 130:1), and this also includes any combination of ranges between about 30:1 and about 150:1. Likewise, all other ranges disclosed herein should be interpreted in a similar manner.

Embodiments of the present invention may provide systems, methods, and/or devices for the production of an aluminum rod from an aluminum bar, the production of an aluminum wire from an aluminum rod, and the production of an aluminum wire from an aluminum bar, in which an annealing step is not needed or required. While not wishing to be bound by theory, Applicants believe that one potential advantage of a process in which an annealing step is not utilized may be increased production rates. For instance, drawing of aluminum wire from aluminum rod may be conducted at line speeds of up to about 10,000 ft/min. However, if the aluminum wire is annealed (e.g., using an in-line annealer), then the line speed may have to be reduced to about 6,000 ft/min, a reduction of about 40%.

Aluminum, as used herein, refers to grades of aluminum and aluminum alloys having at least 98% aluminum by weight, or at least 99% aluminum by weight, including pure or substantially pure aluminum. Aluminum alloys or grades of aluminum having an IACS electrical conductivity of at least 57%, at least 58%, at least 59%, at least 60%, or at least 61% (e.g., from about 61% to almost 65%, from about 61% to about 63%, etc.) may be employed in embodiments disclosed herein. For example, aluminum 1350 alloy may be employed as the aluminum in certain embodiments of this invention. Aluminum 1350, its composition, and its minimum IACS, are described in ASTM B233, the disclosure of which is incorporated herein by reference in its entirety.

Rod, as used herein, refers to a solid product that is long in relation to its cross-sectional area, and may be substantially continuous, and may be produced by a hot-rolling process. The rod may be of any geometric shape, but generally may be cylindrical. Typically, a cylindrical rod may have a diameter in a range from about 0.2 to about 0.35 inches; therefore, contemplated nominal rod diameters may include, but are not limited to, ¼", 9/32", 5/16", ⅓", 11/32", and the like.

Wire, as used herein, refers to a solid product that is long in relation to its cross-sectional area, and may be substantially continuous, and may be produced by a drawing process. The wire may be of any geometric shape, but generally may be cylindrical. Typically, a cylindrical wire may have a diameter in a range from about 0.01 to about 0.175 inches; therefore, contemplated nominal wire diameters may include, but are not limited to, 0.1", 0.107", 0.114", 0.125", 0.15", and the like. Aluminum wires and various tempers (e.g., 1350 aluminum, H16 or H26 temper), as well as tensile strength requirements, are described in ASTM B609, the disclosure of which is incorporated herein by reference in its entirety.

Generally, the processes disclosed herein may be performed continuously, and the bar, rod, and wire materials may be substantially continuous. For example, a continuous bar of aluminum may be converted to a continuous rod of aluminum having a reduced cross-sectional area. Likewise, a continuous aluminum wire may be produced from the continuous aluminum rod.

The starting bar material may be produced in a continuous casting operation—to cast and solidify the aluminum (e.g., an aluminum alloy)—and may be of any geometric shape. For example, the cross-section of the bar may be circular, oval, triangular, square, rectangular, trapezoidal, etc. Although not limited thereto, the cross-sectional area of the bar may be in a range from about 2 to about 12 $in^2$, from about from about 3 to about 11 $in^2$, or from about 4 to about 10 $in^2$.

Referring now to FIG. 1, a method of producing an aluminum wire from an aluminum bar in accordance with an embodiment of the invention is illustrated. An aluminum bar 5, such as may be produced from a casting operation, may be hot-rolled 15 at an elevated temperature, reducing the cross-sectional area to produce an aluminum rod 25. Subsequently, the aluminum rod 25 may be cold-drawn 35 at a temperature less than that employed in the hot-rolling step 15, reducing the cross-sectional area to produce an aluminum wire 45. The method illustrated in FIG. 1 does not include an annealing step.

Hot-rolling 15 the bar 5 to reduce the cross-sectional area and to produce the rod 25 may be conducted at a temperature in a range from about 650° F. to about 1100° F. Accordingly, the hot-rolling step may be conducted at a temperature in a range from about 700° F. to about 1100° F.; alternatively, from about 900° F. to about 1050° F.; alternatively, from about 700° F. to about 1000° F.; alternatively, from about 750° F. to about 1100° F.; alternatively, from about 750° F. to about 950° F.; alternatively, from about 850° F. to about 1050° F.; or alternatively, from about 850° F. to about 950° F. These temperature ranges also are meant to encompass circumstances where the hot-rolling 15 may be conducted at a series of different temperatures (e.g., decreasing temperatures as the cross-sectional area is reduced), instead of at a single fixed temperature, falling within the respective ranges.

For example, the initial rolling temperature and/or incoming bar temperature may be in a range from about 800° F. to about 1100° F., such as, for instance, from about 900° F. to about 1100° F., or from about 950° F. to about 1100° F. The final rolling temperature and/or outgoing rod temperature may be in a range from about 650° F. to about 1000° F., such as, for instance, from about 650° F. to about 900° F., or from about 650° F. to about 800° F.

During hot-rolling 15, coolant may be applied onto the bar/rod and/or onto portions of the hot-rolling equipment. The coolant may comprise water, or may comprise an oil, or may comprise a mixture or emulsion of an oil and water. The coolant may also function, in some embodiments, as a lubricant for certain equipment in the hot-rolling process. The temperature of the coolant may vary depending upon the particular production environment (e.g., output rate, ambient temperature, bar temperature, among other variables). Often, the temperature of the coolant may be in a range from about 120° F. to about 200° F.; alternatively, from about 125° F. to about 200° F.; alternatively, from about 160° F. to about 200° F.; alternatively, from about 130° F. to about 195° F.; alternatively, from about 135° F. to about 185° F.; or alternatively, from about 140° F. to about 180° F.

After rolling, the rod 25 may be quenched or sprayed with, and/or immersed in, a coolant. The coolant may comprise water, or may comprise an oil, or may comprise a mixture or emulsion of an oil and water. For example, the rod may be cooled by immersion in a pipe or other vessel containing a coolant comprising a mixture of an oil and water. If desired, the cooled rod may be coiled.

The cooling process may reduce the temperature of the rod to, and the rod may be coiled at a temperature of, less than about 500° F., such as, for instance, less than about 400° F., less than about 300° F., less than about 250° F., less than about 225° F., less than about 175° F., less than about 150° F., or less than about 125° F.

The hot-rolling process reduces the cross-sectional area of the aluminum. Generally, the ratio of the cross-sectional area of the aluminum bar 5 to the aluminum rod 25 may be in a range from about 30:1 to about 150:1, from about 50:1 to about 130:1, from about 60:1 to about 125:1, from about 70:1 to about 120:1, from about 75:1 to about 120:1, or from about 80:1 to about 115:1.

In certain embodiments, the tensile strength of the aluminum rod 25 may be less than about 12,000 psi; alternatively, less than about 11,750 psi; alternatively, less than about 11,500 psi; alternatively, less than about 11,000 psi; or alternatively, less than about 10,500 psi. For instance, the tensile strength of the rod may be in a range from about 8,000 to about 12,000 psi, from about 9,000 to about 12,000 psi, from about 9,000 to about 11,750 psi, from about 10,000 to about 12,000 psi, from about 10,000 to about 11,750 psi, or from about 10,000 to about 11,500 psi.

Consistent with embodiments disclosed herein, the hot-rolling process 15 of converting a bar 5 to a rod 25 may be accomplished in the absence of any annealing step, whether an intermediate annealing or a final annealing. While not being limited thereto, in certain embodiments the bar 5 may be a generally trapezoidal bar having a cross-sectional area of about 7.36 $in^2$, and the rod 25 may be an approximate 5/16" diameter rod. Such 5/16" diameter rod may have a tensile strength of less than about 11,750 psi, for example, in a range from about 10,000 to about 11,500 psi.

Aluminum rod 25 (e.g., un-annealed) may be drawn through a plurality or series of drawing dies having successively smaller openings to reduce the cross-sectional area, to produce a wire 45 of a desired cross-sectional area (e.g., desired diameter, if a circular cross-section).

Cold-drawing 35 the rod 25 to reduce the cross-sectional area and to produce the wire 45 may be conducted at a temperature in a range from about −40° F. to about 400° F. Accordingly, the cold-drawing step may be conducted at a temperature in a range from about −20° F. to about 400° F.; alternatively, from about 0° F. to about 400° F.; alternatively, from about 40° F. to about 300° F.; alternatively, from about 40° F. to about 250° F.; alternatively, from about 40° F. to about 150° F.; alternatively, from about 40° F. to about 125° F.; alternatively, from about 50° F. to about 120° F.; or alternatively, from about 55° F. to about 100° F. These temperature ranges also are meant to encompass circumstances where the cold-drawing 35 may be conducted at a series of different temperatures (e.g., increasing or decreasing temperatures as the cross-sectional area is reduced), instead of at a single fixed temperature, falling within the respective ranges.

The cold-drawing process reduces the cross-sectional area of the aluminum. Generally, the ratio of the cross-sectional area of the aluminum rod 25 to the aluminum wire 45 may be in a range from about 3:1 to about 10:1, from about 3:1 to about 9.5:1, from about 3.5:1 to about 9.5:1, from about 4:1 to about 9:1, from about 4.5:1 to about 9:1, from about 5:1 to about 10:1, from about 6:1 to about 10:1, from about 6:1 to about 9:1, or from about 5:1 to about 8.5:1.

In certain embodiments, the tensile strength of the aluminum wire 45 may be less than about 23,000 psi; alternatively, less than about 22,500 psi; alternatively, less than about 22,000 psi; alternatively, less than about 21,750 psi; alternatively, less than about 21,500 psi; alternatively, less than about 21,000 psi; alternatively, less than about 20,500 psi; or alternatively, less than about 20,000 psi. For instance, the tensile strength of the wire may be in a range from about 15,000 to about 22,000 psi, from about 16,000 to about 22,000 psi, from about 17,000 to about 22,000 psi, from about 17,000 to about 21,750 psi, or from about 17,000 to about 21,500 psi. In a particular embodiment, the aluminum may be 1350 aluminum and H16 or H26 temper, and the tensile strength may be in a range from about 17,000 to about 22,000 psi, as reflected in ASTM B609 (e.g., the tensile strength may be about 21,500 psi).

Consistent with embodiments disclosed herein, the drawing process 35 of converting a rod 25 to a wire 45 may be accomplished in the absence of any annealing step, whether an intermediate annealing or a final annealing (i.e., the resultant wire is not annealed). While not being limited thereto, in certain embodiments the rod 25 may be an approximate 5/16" diameter rod, and the wire 45 may have a diameter of about 0.114". Such 0.114" diameter wire may have a tensile strength of less than about 22,000 psi, for example, in a range from about 17,000 psi to about 21,750 psi.

While certain embodiments of the invention have been described, other embodiments may exist. Further, any disclosed methods' stages may be modified in any manner, including by reordering stages and/or inserting or deleting stages, without departing from the invention. While the specification includes examples, the invention's scope is indicated by the following claims. Furthermore, while the specification has been described in language specific to structural features and/or methodological acts, the claims are not limited to the features or acts described above. Rather, the specific features and acts described above are disclosed as illustrative embodiments of the invention.

EXAMPLES

Constructive Example 1

Aluminum 1350 alloy may be used as the aluminum grade. A substantially continuous trapezoidal bar having a cross-sectional area of 7.36 $in^2$ may enter a rolling mill at 1000-1100° F. for hot rolling to form a substantially continuous 5/16" diameter rod, having a cross-sectional area of 0.0767 $in^2$. The ratio of the cross-sectional area of the aluminum bar to the aluminum rod may be approximately 96:1. While hot-rolling, coolant at 165° F. may be applied onto the bar/rod and/or onto the rolling equipment. The aluminum rod may exit the rolling mill at a temperature in the 650-1000° F. range, for instance, 850° F.

The aluminum rod may be cooled by immersion in a pipe or other vessel containing a coolant mixture of water/oil. The temperature of the rod may be reduced to less than 200° F., for instance, to 100° F. The cooled aluminum rod may be coiled, if desired. The tensile strength of the 5/16" aluminum rod may be 10,500-11,000 psi or less.

Without annealing, the 5/16" diameter rod (cross-sectional area of 0.0767 $in^2$) may be cold drawn to from substantially continuous 0.114" diameter (cross-sectional area of 0.0102 $in^2$) aluminum wire. The ratio of the cross-sectional area of the aluminum rod to the aluminum wire may be approximately 7.5:1. The cold-drawing may be conducted at ambient temperature, around 70-80° F. The resultant aluminum wire is not annealed and may have a tensile strength of less than 21,000-22,000 psi.

Examples 2-6

Examples 2-6 illustrate the impact on tensile strength of drawing down soft ⅜" aluminum 1350 rod to 0.112" aluminum wire. It was desired to produce wire having a tensile strength of 22,000 psi or less, but with no annealing of the wire. The drawing environment for these experiments was at room temperature. As the aluminum was drawn through successive dies, the temperature of the aluminum rod/wire increased. Cooling was used during the drawing process, but the temperature of aluminum was not controlled.

The rod was drawn through successive dies having diameters of 0.334", 0.296", 0.262", 0.232", 0.181", 0.162", 0.143", 0.126", and 0.112", and tensile strength measurements of the aluminum were taken at diameters of 0.296", 0.232", 0.181", 0.143", and 0.112". The tensile strength of the initial ⅜" soft aluminum also was measured. The results are summarized in Table I. As shown in Table I, the soft aluminum rod at ⅜" had an average tensile strength of about 10,700 psi. Even with this relatively low tensile strength, it was not possible to maintain a tensile strength of less than 22,000 psi for 0.112" wire. The average tensile strength of the 0.112" wire was about 23,200 psi. In four of the five examples, the tensile strength of the 0.112" wire was in excess of 23,000 psi, well above the target of 22,000 psi or less.

TABLE I

Tensile Strengths of Examples 2-6 (psi).

| Example | 2 | 3 | 4 | 5 | 6 |
|---|---|---|---|---|---|
| 3/8" | 11,700 | 10,700 | 10,200 | 10,600 | 10,500 |
| 0.296" | 17,100 | 17,200 | 17,200 | 17,300 | 16,800 |
| 0.232" | 19,300 | 19,600 | 19,400 | 19,600 | 19,000 |
| 0.181" | 20,600 | 21,700 | 20,800 | 22,400 | 22,000 |
| 0.143" | 22,300 | 23,000 | 22,200 | 23,000 | 23,200 |
| 0.112" | 23,400 | 21,000 | 24,800 | 23,400 | 23,600 |

Examples 7-9

Examples 7-9 illustrate the impact on tensile strength of drawing down 5/16" aluminum 1350 rod to 0.114" aluminum wire. It was desired to produce wire having a tensile strength of 22,000 psi or less, but with no annealing of the wire. The drawing environment for these experiments was at room temperature. As the aluminum was drawn through successive dies, the temperature of the aluminum rod/wire increased. Cooling was used during the drawing process, but the temperature of aluminum was not controlled.

The rod was drawn through successive dies having diameters of 0.293", 0.261", 0.231", 0.205", 0.182", 0.162", 0.144", 0.129", and 0.114", and tensile strength measurements of the aluminum were taken at each of these diameters. The tensile strength of the initial 5/16" aluminum at varying hardness's also was measured. The results are summarized in Table II. As shown in Table II, the soft 5/16" aluminum rod of Example 9 had a tensile strength of about 10,900 psi, and was successfully drawn down to 0.114" wire at a tensile strength of less than 22,000 psi. Based on Examples 7-8, when the tensile strength of the rod greatly exceeds 12,000 psi, it may be difficult to produce 0.114" wire having a tensile strength of less than 22,000 psi without annealing.

TABLE II

Tensile Strengths of Examples 7-9 (psi).

| Example | 7 | 8 | 9 |
|---|---|---|---|
| 5/16" | 13,800 | 12,900 | 10,900 |
| 0.293" | 15,400 | 14,300 | 13,800 |
| 0.261" | 17,400 | 16,400 | 14,700 |
| 0.231" | 18,900 | 17,700 | 16,500 |
| 0.205" | 19,400 | 19,200 | 17,800 |
| 0.182" | 20,800 | 19,000 | 18,400 |
| 0.162" | 21,600 | 20,700 | 19,700 |
| 0.144" | 22,200 | 21,400 | 20,500 |
| 0.129" | 22,900 | 22,400 | 20,800 |
| 0.114" | 23,400 | 22,600 | 21,800 |

What is claimed is:

1. A method for producing an aluminum wire from an aluminum rod, the method comprising:

cold-drawing the aluminum rod at a temperature in a range from about −40° F. to about 400° F. to reduce the cross-sectional area, producing the aluminum wire;

wherein the aluminum rod is a cylindrical rod having a diameter in a range from about 0.2" to 0.35", the ratio of the cross-sectional area of the aluminum rod to the aluminum wire is in a range from about 3:1 to about 10:1, the aluminum wire has a tensile strength in a range from about 17,000 to about 22,000 psi, and the aluminum wire is not annealed.

2. The method of claim 1, wherein the aluminum wire has a tensile strength in a range from about 17,000 to about 21,750 psi.

3. The method of claim 1, wherein:

the aluminum wire and the aluminum rod comprise an aluminum 1350 alloy;

the aluminum wire is a cylindrical wire having a diameter in a range from about 0.01" to about 0.175";

the temperature is in a range from about 40° F. to about 250° F.; and the ratio is in a range from about 4:1 to about 9:1.

4. The method of claim 1, wherein:

the aluminum wire and the aluminum rod are an aluminum 1350 alloy;

the aluminum wire is a cylindrical wire having a diameter in a range from about 0.1" to about 0.15";

the aluminum rod is a cylindrical rod having a diameter in a range from about ¼" to about 11/32";

the temperature is in a range from about 50° F. to about 120° F.;

the ratio is in a range from about 6:1 to about 10:1; and the aluminum wire has a tensile strength in a range from about 17,000 to about 21,750 psi.

5. The method of claim 1, wherein:

the aluminum wire is a cylindrical wire having a diameter of about 0.114";

the aluminum rod is a cylindrical rod having a diameter of about 5/16";

the temperature is in a range from about 55° F. to about 100° F.;

the ratio is in a range from about 6:1 to about 9:1; and the aluminum wire has a tensile strength in a range from about 17,000 to about 21,500 psi.

6. The method of claim 1, wherein the aluminum wire is an aluminum 1350 alloy H16 or H26 temper.

7. The method of claim 1, wherein:

the aluminum wire and the aluminum rod are an aluminum 1350 alloy;

the aluminum wire is a cylindrical wire having a diameter in a range from about 0.1" to about 0.15"; and the ratio is in a range from about 4:1 to about 9:1.

8. A method for producing an aluminum wire from an aluminum bar, the method comprising:

hot-rolling the aluminum bar at a rolling temperature in a range from about 650° F. to about 1100° F. to reduce the cross-sectional area, producing an aluminum rod;

cold-drawing the aluminum rod at a drawing temperature in a range from about −40° F. to about 400° F. to reduce the cross-sectional area, producing the aluminum wire;

wherein:

the aluminum rod is a cylindrical rod having a diameter in a range from about 0.2" to 0.35", the aluminum wire has a tensile strength in a range from about 17,000 to about 22,000 psi, a rolling ratio of the cross-sectional area of the aluminum bar to the aluminum rod is in a range from about 30:1 to about 150:1, a drawing ratio of the cross-sectional area of the aluminum rod to the aluminum wire is in a range from about 3:1 to about 10:1, and the aluminum rod and the aluminum wire are not annealed.

9. The method of claim 8, wherein the aluminum wire has a tensile strength in a range from about 17,000 to about 21,750 psi.

10. The method of claim 8, wherein:

the aluminum bar and the aluminum wire comprise an aluminum 1350 alloy;

the aluminum bar has a cross-sectional area in a range from about 2 to about 12 $in^2$;

the aluminum wire is a cylindrical wire having a diameter in a range from about 0.01" to about 0.175";

the rolling ratio is in a range from about 50:1 to about 130:1;

the drawing ratio is in a range from about 4:1 to about 9:1;

the rolling temperature is in a range from about 700° F. to about 1000° F.;

the drawing temperature is in a range from about 40° F. to about 250° F.; and the aluminum rod has a tensile strength of less than about 12,000 psi.

11. The method of claim 8, wherein:

the aluminum bar and the aluminum wire are an aluminum 1350 alloy;

the aluminum bar has a cross-sectional area in a range from about 3 to about 11 $in^2$;

the aluminum wire is a cylindrical wire having a diameter in a range from about 0.1" to about 0.15";

the rolling ratio is in a range from about 70:1 to about 120:1;

the drawing ratio is in a range from about 6:1 to about 10:1;

the rolling temperature is in a range from about 850° F. to about 1050° F.;

the drawing temperature is in a range from about 50° F. to about 120° F.;

the aluminum rod has a tensile strength of less than about 11,750 psi; and the aluminum wire has a tensile strength in a range from about 17,000 to about 21,750 psi.

12. The method of claim 8, wherein:

the aluminum bar has a cross-sectional area in a range from about 4 to about 10 $in^2$;

the aluminum rod is a cylindrical rod having a diameter of about 5/16";

the aluminum wire is a cylindrical wire having a diameter of about 0.114";

the rolling ratio is in a range from about 80:1 to about 115:1;

the drawing ratio is in a range from about 6:1 to about 9:1;

the rolling temperature is in a range from about 900° F. to about 1050° F.;

the drawing temperature is in a range from about 55° F. to about 100° F.;

the aluminum rod has a tensile strength in a range from about 10,000 to about 12,000 psi; and the aluminum wire has a tensile strength in a range from about 17,000 to about 21,500 psi.

13. The method of claim 8, further comprising a step of cooling the aluminum rod to a temperature of less than about 250° F. after hot-rolling.

14. The method of claim 8, wherein the aluminum wire is an aluminum 1350 alloy H16 or H26 temper.

15. A method for producing an aluminum wire from an aluminum rod, the method comprising:

cold-drawing the aluminum rod at a temperature in a range from about −40° F. to about 400° F. to reduce the cross-sectional area, producing the aluminum wire; wherein:

the aluminum wire is a cylindrical wire having a diameter in a range from about 0.1" to about 0.15";

the aluminum rod is a cylindrical rod having a diameter in a range from about 1/4" to about 11/32";

the ratio of the cross-sectional area of the aluminum rod to the aluminum wire is in a range from about 5:1 to about 8.5:1;

the aluminum wire has a tensile strength in a range from about 17,000 to about 22,000 psi; and the aluminum wire is not annealed.

16. The method of claim 15, wherein:

the aluminum wire is a cylindrical wire having a diameter of about 0.114"; and the aluminum rod is a cylindrical rod having a diameter of about 5/16".

* * * * *